United States Patent [19]

Knestele

[11] 4,096,601

[45] Jun. 27, 1978

[54] CLEANING APPARATUS FOR CARPETS, UPHOLSTERY AND THE LIKE

[76] Inventor: Leopold Knestele, 7967 Bad Waldsee, Germany

[21] Appl. No.: 651,688

[22] Filed: Jan. 23, 1976

[30] Foreign Application Priority Data

Jan. 25, 1975 Germany ..... 2503012

[51] Int. Cl.[2] ..... A47L 11/34

[52] U.S. Cl. ..... 15/320; 15/50 C; 15/337

[58] Field of Search ..... 15/50 C, 320, 321, 328, 15/337

[56] References Cited

U.S. PATENT DOCUMENTS

| | | | |
|---|---|---|---|
| 1,283,499 | 11/1918 | Gray | 15/320 X |
| 1,625,147 | 4/1927 | Onofrio | 15/320 X |
| 2,622,254 | 12/1952 | Mendelson | 15/320 X |
| 3,204,280 | 9/1965 | Campbell | 15/328 X |
| 3,942,215 | 3/1976 | Olds | 15/320 |

FOREIGN PATENT DOCUMENTS

| | | | |
|---|---|---|---|
| 1,922,651 | 12/1970 | Germany | 15/320 |

*Primary Examiner*—Christopher K. Moore
*Attorney, Agent, or Firm*—Montague & Ross

[57] ABSTRACT

A cleaning apparatus for carpets, upholstery and the like in which a housing is displaceable along the surface to be cleaned and is provided with a motor-driven suction device, a foam-applying device and a pulsating scrubbing (massaging) device, the latter two devices being selectively operational apart from or together with a rotatable brush by control elements. The foam-applying (shampooing) device and the scrubbing device can be selectively coupled to the same motor as is used to drive the brush and the suction device.

8 Claims, 4 Drawing Figures

CLEANING APPARATUS FOR CARPETS, UPHOLSTERY AND THE LIKE

FIELD OF THE INVENTION

My present invention relates to a cleaning apparatus for carpetry, upholstery and the like of the type in which a housing, forming a cleaning head, is displaceable along the surface to be cleaned and has a suction compartment adapted to draw up dirt or other materials on this surface and deposit it in a collecting vessel. More particularly the invention relates to improvements in vacuum cleaners and the like and, most especially, vacuum cleaners having rotatable brushes engageable with the surface to be cleaned.

BACKGROUND OF THE INVENTION

Floor and carpet cleaning apparatus and appliances have become available in a variety of sizes, configurations and complexities, depending upon the cleaning requirements, the nature of the manipulation desired and the types of materials to be removed from the surface.

For example, so-called brush vacuums generally comprise a cleaning head, at the end of a tube connected to a vacuum-cleaner canister or as part of an upright vacuum cleaner, which comprises a suction or vacuum compartment in which a brush is driven by a motor so that contaminants on the floor or another surface to be cleaned, are loosened or carried up from the nap of a carpet and can be entrained by a suction stream of air induced through the head.

Of course there are also vacuum cleaner arrangements in which the head has a static soil loosener, i.e., no rotatable brush is provided, cleaning devices which are not provided with a vacuum or suction compartment, and various upright and cansiter (tank) cleaners with a host of attachments for performing different cleaning functions. These accessories can be used, for example, for the cleaning of upholstery, furniture and curtains.

Apart from such units, there have been devices, so-called shampooers, which apply a cleaning foam to the surface and are designed to cause the dirt particles to be lifted to the surface of the carpet in the foam so that these particles can be picked up by a vacuum device such as one of the vacuum cleaner arrangements mentioned above. The foam-applying unit or shampooer is generally formed with a liquid applicator, e.g. a container for the "shampoo" and some means for rubbing the same into carpet.

Two devices for the treatment of a carpet or upholstered surfaced can be expensive, incovenient to handle and difficult to efficiently employ and hence rug shampooing and like tasks have been performed only with alacrity by most housewives and generally are left to professional rug and carpet cleaners. The ordinary householder is not able to cope with the number of appliances required for a full range of cleaning operations and, in general, the capital cost of such units has been prohibitive heretofore.

OBJECTS OF THE INVENTION

It is the principal object of the present invention to provide cleaning apparatus capable of performing ordinary rotating-brush vacuum cleaning as well as rug and carpet shampooing and hence to make available in one unit substantially all of the functions discussed above.

Another object of the invention is to provide an improved rug, carpet and upholstery apparatus which avoids the disadvantages of earlier systems.

It is also an object of the invention to improve existing appliances, be they for rotary-brush vacuuming or carpet shampooing, in such manner that corresponding functions can be carried out more effectively and with a greater degree of cleaning.

SUMMARY OF THE INVENTION

These objects and others which will become apparent hereinafter are attained, in accordance with the present invention, in an apparatus for the cleaning of carpeting, rugs, upholstery and the like which comprises a cleaning head formed with a housing open downwardly toward the surface to be cleaned and formed, in one portion thereof, with a downwardly open suction chamber receiving a rotatable motor-driven brush.

Another portion of this housing receives a foam or shampoo applicator which is preferably also motor-driven and, according to an important feature of this invention, the housing comprises, in addition, a pulsating scrubbing body (massager) which periodically can engage the surface to be cleaned to rub the cleaning foam into the latter.

Advantageously, the housing is provided with a handle at a rear end thereof, the handle carrying a filter bag for contaminants which is connected to the motor-driven blower as well as a reservoir for the shampoo or foam applicator.

It has been found to be important, for effective operation of the device, to provide the suction or vacuum chamber at the forward end of this housing (at which the motor-driven brush is positioned), to dipose the shampoo or foam applicator at the rearward end of the housing, and to provide the scrubbing (massage) body between the vacuum and foam-applying device at an intermediate location between the forward and rearward ends.

According to a feature of the invention, a common drive source is provided for the suction device (blower), the motor-driven brush, the scrubbing body and the foam or shampoo applicator; the latter two devices are connectible to the motor by hand-operated control elements so that they may be both driven or stopped while the rotating brush of the vacuum compartment is driven or stopped.

The drive arrangement can comprise a pair of friction rollers having a high speed-reduction ratio, one friction roller being connected to an eccentric for operating the rotating brush and the other to a drive train for the massage body and the shampoo or foam applicator, and bell-crank level arrangements for selectively shifting the frictions wheels into contact with a common drive wheel preferably disposed between the two friction wheels and constituting a shaft of the suction-blower motor. The friction wheels are preferably connected to the driven shafts of the rotatable brush, scrubbing body and the shampooing device by elastic-belt means and appropriate sheaves.

The apparatus described has the advantage that all practical cleaning requirements can be met for the ordinary vacuum cleaning and the more extensive shampooing of carpets, upholstery, drapes and the like with a single unit having, as an essential element, the new pulsating scrubbing body or massage body rubs the foam or shampoo into the carpet and greatly increases the soil-binding effect of the foam.

Of course, with the manual control elements of the invention it is possible to operate purely with the rotating-brush vacuum aspect, in which case the pulsating massager and the shampoo applicator are cut off. Of course it is also possible to disconnect the rotating brush and operate purely by vacuum.

The drive systems for the rotating brush and the shampooing and massaging units, according to the invention, have high speed reduction ratios. With respect to the rotating brush this has been found to be important because an excessive brush speed not only causes undue wear of the brush and the carpet, but interferes with proper soil-pickup action of the vacuum. The use of friction rolls or wheels and elastic belts as part of the drive keeps the noise to a minimum and minimizes wear.

It has been found to be advantageous to simplify the control operations of the device connecting the swingable lever or control of the foam or shampooing device with the cutoff valve for the cleaning or foaming agent, i.e. the shampoo, so that when the shampooing device is rendered operative, the shampoo is fed to the applicator and when the shampooing device is cut off from the motor, the supply of the cleaning agent is likewise terminated.

It has been found to be advantageous, moreover, to provide each of the manually actuable controls or the pivotal levers as a cam which is engageable in a notch, recess or other formation of the swingable lever to retain it against the bias of a spring which urges the friction wheel in the direction of the drive shaft. This cam can be rotated into an ineffective position by a manually controlled lever disposed on the housing for direct operation or for operation by a Bowden cable from, for example, the handle of the device. For simplicity of manipulation, I prefer to provide the manual lever for controlling the rotating brush on the left hand longitudinal flank of the housing and the control lever for the foam unit with the massaging body on the handle of the device and connected to the associated cam by a Bowden cable.

According to another feature of the invention, the scrubbing or massaging body is constituted as a roller of soft elastic foam material eccentrically journaled on a rotating shaft, the latter being connected by an elastic belt driven with the shaft of the respective friction wheel. Since the massage roller is freely rotatable on its eccentric axis which in turn is swung about the axis of the eccentric shaft, the entire surface of the scrubbing or massage roll is eventually brought into contact with the surface and wears uniformly. In other words the effective floor-engaging zone of the surface of the scrubbing or massage roll is continuously changing.

It has been found to be advantageous, moreover, to provide an outer wall of the housing with an orifice closable by a cover and adapted to accommodate a suction pipe connected to a housing at whose end accessories can be provided, the orifice opening into the suction compartment or directly, i.e. in hermetically sealed relationship with the intake of the blower housing.

The accessories which can be used with the hose include an upholstery brush or nozzle or other device for the cleaning of curtains, upholstery, furniture or the like. It is advantageous in this case that the brush of the housing be turned off and that the air stream of the suction blower be effective without deflection so that the entire motor force be available for generating the suction applied to the accessory.

Since the massage or scrubbing roller is only required for part of the time, e.g. is not necessary when only rotating brush vacuuming is performed, I prefer to close the window in the housing through which the massage roller is effective, preferably by a shiftable slide plate.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figures 3, 4:
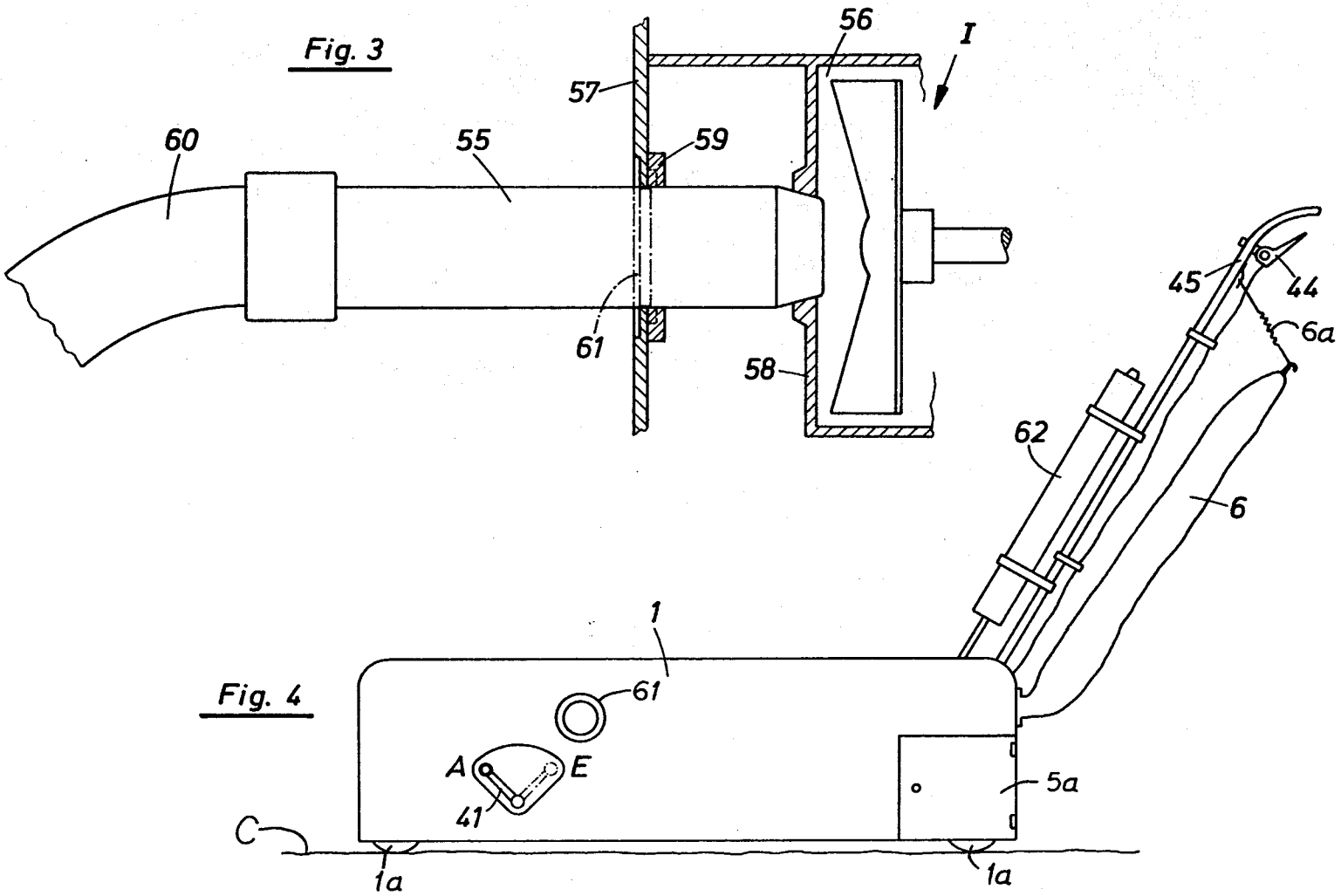
FIG. 3 shows a detail of the connecting system for an accessory hose.
FIG. 4 is an elevational view showing the basic configuration of the apparatus.

The apparatus illustrated in FIG. 4 comprises an upright handle 45 and a head 1 which is displaceable on rollers 1a along a floor surface C to be cleaned. An electrical conductor connected to the motor of the head 1 may also pass through this handle and may be connected to a wall outlet in the usual manner. The head 1 is connected to a filter bag 6 which collects the dust picked up by the suction device, the bag being retained by a spring 6a at the upper part of the handle. The handle also carries a container 62 for a cleaning fluid such as a foaming agent or shampoo and an actuating lever 44 connected to a Bowden cable 43 and the function of which will be described subsequently.

Figure 1:
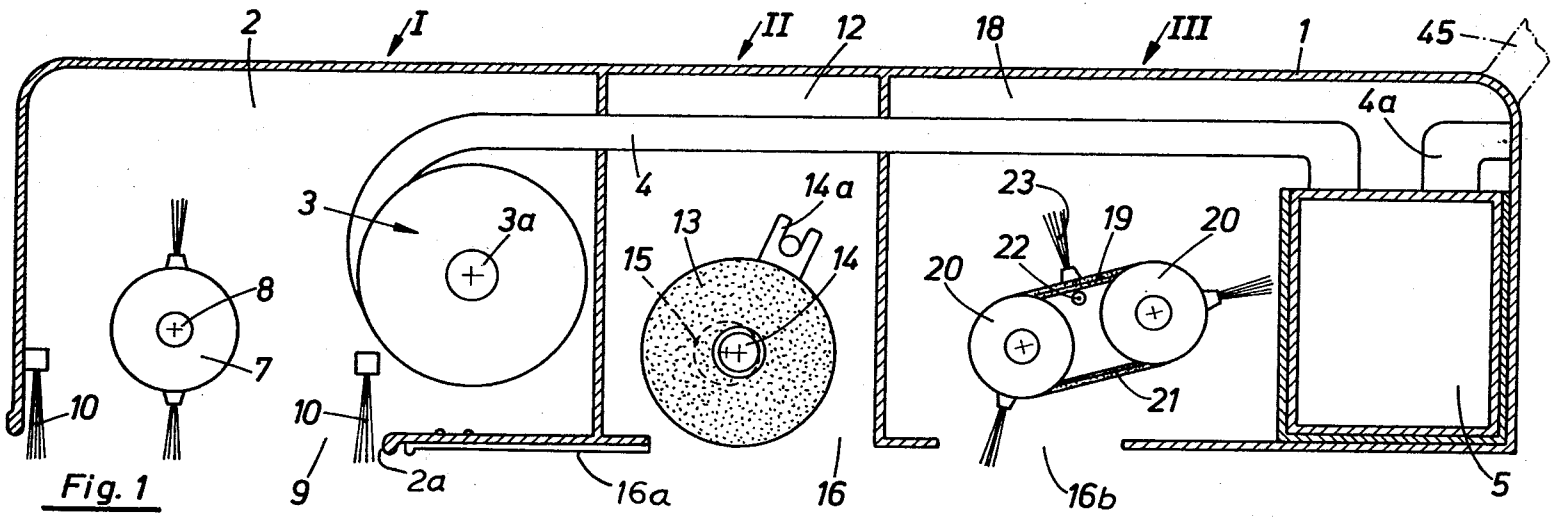
FIG. 1 is a vertical cross section, partly in diagrammatic form, illustrating the elements of an apparatus according to the invention.

FIG. 1 shows the basic organization of the individual units I, II and III of the apparatus, these units being disposed one behind the other within the housing 1.

The first unit I comprises a suction chamber 2 at the front end of the housing and receiving motor-driven blower whose scroll is connected at its output side by a pipe 4 to the top of a dirt receptacle 5 which can be removed laterally from the housing, e.g. through a door 5a best seen in FIG. 4. The top of the dirt container is connected by an elbow pipe 4a with the dust sack 6.

Ahead of the suction blower 3, I provide a rotating brush 7 which is journaled on a shaft 8 and driven by a belt drive 29 as will be described in connection with FIG. 2. The window 2a of the chamber is flanked by a pair of stationary brushes 10 which promote the cleaning operation. A chamber 12 behind the chamber 2 accommodates the unit II which comprises a vibrating body 13 in the form of a roll of soft elastic foam journaled on a pair of opposite spaced eccentric pins 14 for free rotation thereon. The eccentric pins 14 are carried by respective shafts 15 on opposite sides and which are rotatable in the housing 1. One of these shafts 15 is connectable with the motor of the blower as will be described in connection with FIG. 2. The position of the vibrating body is adjustable so that the surface of the scrubbing roller will periodically emerge through the window 6 of chamber 12 and vibratingly engage the carpet surface. A device 14a permits the vibrating body 13 to be retained in an inwardly recessed position. A slide 16a can be shifted to the right (FIG. 1) to close the window 16 when the vibrating body is not needed.

At the rear end of the housing I provide a chamber 18 which receives the shampoo applicator. To this end a pair of rollers 20 are journaled in spaced apart relationship in this chamber so that their axes lie along a common plane inclined forwardly and downwardly toward the surface. A brush belt 19 passes around the rollers 20 and is provided with the bristles 23 along its outer surface. The inner surface of the belt is formed with a bibulous foam-plastic layer 21 which can pick up shampoo emerging from the orifice 22, and as this layer passes around the rolls, squeeze to dispense the shampoo through openings in the belt 19 to pass along the bristles 23 and into contact with the carpet through the window **16*b* of chamber 18**.

The opening 22 is connected via the valve 50–53 to the shampoo supply vessel 62.

When the unit I operates to the exclusion of unit II and III, rotating-brush suction allows a carpet surface or the like to be cleaned as the head is moved thereover. When the rotating brush 7 is immobilized, only suction cleaning using the static brushes 10 is effected. When units II and III are brought into place, the foam is applied by the brush 23 to the carpet surface and is scrubbed or rubbed into the depths of the carpet by the roller 13. The soil lifted to the surface of the carpet by the foam is sucked up through the intake **3*a* of blower 3 and is carried as moist particles into the receptacle 5 at which it settles from the air stream which then passes through the dust sack 6**.

Figure 2:
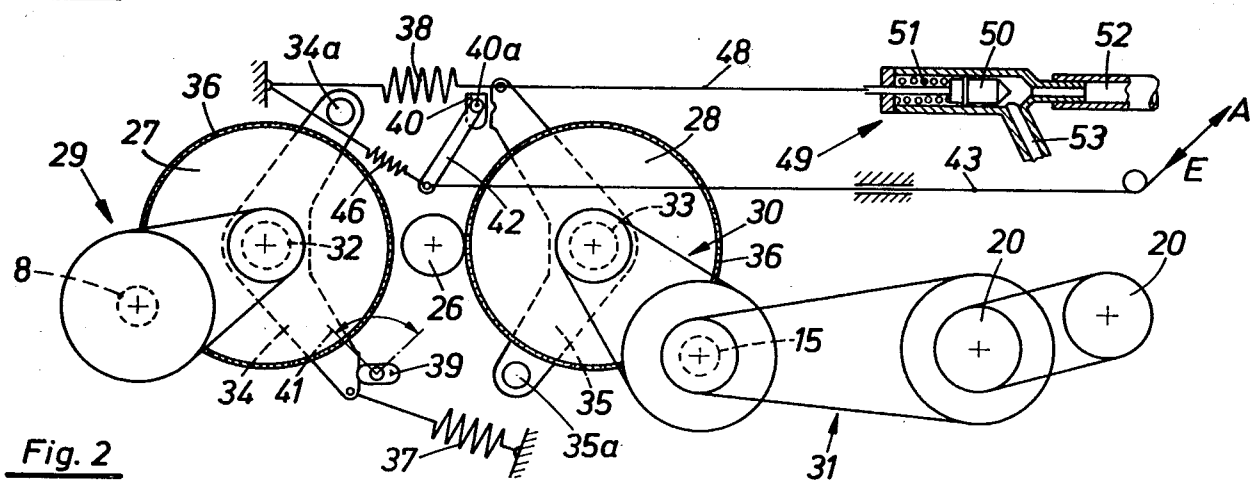
FIG. 2 is a side view of the drive system, likewise in diagrammatic form.

The control device has been illustrated in FIG. 2.

The shaft 26 of the motor driving the suction blower 3 is disposed between a pair of friction wheels 27 and 28 which have soft elastic surfaces 36 and are disposed to engage the surface of the shaft 26. The friction wheel 27 is connected by a step-down belt drive 29 with the shaft 8 of the rotating brush 7.

Friction wheel 28 is connected by a step-down elastic belt drive 30 with the shaft 15 which in turn is connected by a step-down elastic belt drive 31 with rollers 20 of the foam applicator unit III. The shafts 32 and 33 of the friction wheels 27 and 28, respectively, are each rotatably mounted on respective belt crank levers 34 and 35 which are pivotally mounted at one end **34*a* and 35*a* on the housing. The other ends of these levers are urged by springs 37 and 38, respectively, in such direction as to bias the friction wheels 27 and 28 toward the shaft 26**.

To retain the levers 34 and 35 in positions in which their wheels do not engage the shaft 26, there are provided control cams 39 and 40 which are adapted to engage in notches at the free end of the bell crank levers. The cams themselves are rotatable on the housing about axes parallel to the pivot axis of the bell crank levers.

The cam 39 is connected via a shaft passing through the wall of the left hand longitudinal side of housing 1, with an actuating or control lever 41 which can shift the cam 39 between the disengaged position A and the engaged position E of the friction wheel 27. Thus the rotating brush is either stopped (undriven) or driven by the shaft 26.

The cam 40 is carried by a lever 42 which is urged in the clockwise sense by a spring 46 but can be drawn in the counter-clockwise by the Bowden cable 43 connected to the control lever 44 on the handle 45 of the device. When the Bowden cable is tensioned, therefore, it is shifted in the direction of arrow A to retain the friction wheel 28 out of engagement with the shaft 26. Conversely, when the Bowden cable is permitted to move in the opposite direction E the friction wheel 28 engages the shaft 26 and units II and III are driven. Between the bell crank lever 35 and a valve member 50, there is provided a further cable 58 which draws the valve member 50 out of its engagement with its seat against the force of a spring 51 so that shampoo or foaming agent is permitted to flow from the tube 52 connected to the reservior 62 to a passage 53 opening into orifice 22. The valve 49 thus controls the flow of the shampoo in accordance with the actuation of the foam applicator and vibrator roller.

FIG. 3 shows that the wall 57 of the housing 1 is provided with an opening which can be sealed by a plug or cover 61 and through which a suction tube 55 can be introduced into the suction chamber 56 of the blower 1 through the intake thereof. The housing 58 of the blower may thus be shaped to sealingly engage the suction tube 55 at the intake and the tube can be held in place by a bayonet lock 59 of conventional design. The free end of the tube 55 is provided with a suction hose 60 which can carry a nozzle, brush or the like as described above.

While unit I and units II + III can be operated independently or together, it is also possible to operate unit I without driving the rotating brush in a purely suction mode.

I claim:

1. An apparatus for the cleaning of carpets, upholstery and the like comprising:

a housing formed with wall means defining a downwardly open suction compartment containing a rotatable brush at a leading end of said housing, means for sucking air out of said compartment, a flexible-surface vibrating body rearward of said compartment for engagement with the surface to be cleaned, said vibrating body being drivable to vibrate foam into said surface to be cleaned, a foam applicator in said housing rearward of said vibrating body, and means for feeding a foamable cleaning liquid to said applicator, said applicator comprising a belt provided with bristles and a pair of rollers spanned by the belt and rotatable to displace said bristles to apply said foamable cleaning liquid to said surface to be cleaned; and manually controlled drive means for selectively operating either said brush alone or both said body and said applicator in conjunction.

2. The apparatus defined in claim 1 wherein said means for sucking air includes a suction blower in said compartment having a motor provided with a shaft, said body being eccentrically mounted on a vibrator shaft, said drive means comprising first and second friction wheels, respective bellcrank levers pivotally mounted on said housing and carrying said wheels for selectively shifting same into frictional contact with said shaft of said motor, said drive means including a respective elastic-belt step-down transmission connecting one of said friction wheels with a shaft of said brush and the other of said friction wheels with said vibrator shaft and said rollers.

3. The apparatus defined in claim 2, wherein said feeding means including a container for said foamable cleaning liquid, a fluid line connecting said container to said applicator, and a valve interposed between said applicator and said container, means connecting the lever carrying said other friction wheel with said valve to permit flow of said foamable cleaning liquid to said applicator upon engagement of said other friction wheel with said shaft of said motor.

4. The apparatus defined in claim 2, further comprising respective rotatable cams engageable with free ends of the respective levers for retaining the respective wheels out of engagement with said shaft of said motor; and respective springs connected to said levers for urging said wheels toward engagement with said shaft of said motor, and actuating levers operable externally of said housing for controlling the position of said cams.

5. The apparatus defined in claim 4 wherein the actuating lever for controlling the position of the cam for the friction wheel of said brush is disposed along a side of said housing and the actuating lever for controlling the other cam is connected thereto by a Bowden cable, said apparatus having a handle and the last mentioned actuating lever being mounted on said handle.

6. The apparatus defined in claim 2 wherein said vibrating body is a roller of soft elastic foam rotatable about an axis, said vibrator shaft carrying said roller and being rotatable about another axis parallel to but spaced from the first-mentioned axis, said vibrator shaft being driven by said other of said friction wheels, said apparatus further comprising another reduction transmission between said vibrator shaft and said applicator.

7. The apparatus defined in claim 2 wherein said housing is formed with a coverable opening, said apparatus further comprising a hose-carrying suction tube adapted to pass through said opening and communicate with said blower, said suction tube locking onto said housing at said opening.

8. The apparatus defined in claim 2 further comprising a slide for closing said opening in an inoperative condition of said body thereof.

* * * * *